US009029306B2

(12) United States Patent
Takagi et al.

(10) Patent No.: US 9,029,306 B2
(45) Date of Patent: May 12, 2015

(54) WATER-SOLUBLE METALWORKING OIL AGENT AND USAGE THEREOF

(75) Inventors: Fumiaki Takagi, Ichihara (JP); Yoichiro Jido, Ichihara (JP)

(73) Assignee: Idemitsu Kosan., Ltd., Tokyo (JP)

( * ) Notice: Subject to any disclaimer, the term of this patent is extended or adjusted under 35 U.S.C. 154(b) by 332 days.

(21) Appl. No.: 13/498,817

(22) PCT Filed: Nov. 24, 2010

(86) PCT No.: PCT/JP2010/070875

§ 371 (c)(1), (2), (4) Date: Mar. 28, 2012

(87) PCT Pub. No.: WO2011/065355

PCT Pub. Date: Jun. 3, 2011

(65) Prior Publication Data

US 2012/0184475 A1 Jul. 19, 2012

(30) Foreign Application Priority Data

Nov. 30, 2009 (JP) ..... 2009-272050

(51) Int. Cl.

*C10M 173/02* (2006.01)
*C07C 59/00* (2006.01)
*C10M 173/00* (2006.01)

(52) U.S. Cl.

CPC ..... *C10M 173/00* (2013.01); *C10M 2203/106* (2013.01); *C10M 2203/1065* (2013.01); *C10M 2207/125* (2013.01); *C10M 2207/126* (2013.01); *C10M 2207/127* (2013.01); *C10M 2207/281* (2013.01); *C10M 2207/288* (2013.01); *C10M 2207/289* (2013.01); *C10M 2209/104* (2013.01); *C10M 2215/02* (2013.01); *C10M 2215/044* (2013.01); *C10M 2215/223* (2013.01); *C10N 2220/022* (2013.01); *C10N 2230/06* (2013.01); *C10N 2240/401* (2013.01); *C10N 2240/406* (2013.01); *C10N 2240/409* (2013.01)

(58) Field of Classification Search

USPC ..... 508/455, 505; 554/213, 219
See application file for complete search history.

(56) References Cited

U.S. PATENT DOCUMENTS

| | | | | |
|---|---|---|---|---|
| 4,292,187 | A | 9/1981 | Hentschel et al. | |
| 2003/0134757 | A1* | 7/2003 | Milbrath et al. | 508/463 |

FOREIGN PATENT DOCUMENTS

| | | | |
|---|---|---|---|
| CN | 1575330 | A | 2/2005 |
| JP | 55 123695 | | 9/1980 |
| JP | 60 141795 | | 7/1985 |
| JP | 2-5799 | | 2/1990 |
| JP | 2 119925 | | 5/1990 |
| JP | 4 202298 | | 7/1992 |
| JP | 7 97590 | | 4/1995 |
| JP | 7 286192 | | 10/1995 |
| JP | 8 27473 | | 1/1996 |
| JP | 8 302373 | | 11/1996 |
| JP | 9 176666 | | 7/1997 |
| JP | 10 8077 | | 1/1998 |
| JP | 10 85872 | | 4/1998 |
| JP | 11 279577 | | 10/1999 |
| JP | 2000 63863 | | 2/2000 |
| JP | 2000 256695 | | 9/2000 |
| JP | 2002 146380 | | 5/2002 |
| JP | 2004 256771 | | 9/2004 |
| JP | 2007 204603 | | 8/2007 |
| JP | 2010 254813 | | 11/2010 |
| WO | WO 03/035809 | A1 | 5/2003 |

OTHER PUBLICATIONS

International Search Report Issued Jan. 18, 2011 in PCT/JP10/70875 Filed Nov. 24, 2010.

Office Action issued on May 20, 2013 in the corresponding Chinese Patent Application No. 201080054793.5 (with English Translation).

* cited by examiner

*Primary Examiner* — Vishal Vasisth

(74) *Attorney, Agent, or Firm* — Oblon, McClelland, Maier & Neustadt, L.L.P.

(57) ABSTRACT

A water-soluble metalworking oil agent is provided by blending the following components A, B, C and D:

(A) at least one of a condensed fatty acid obtained by dehydration-condensing a ricinoleic acid, and a condensed fatty acid obtained by dehydration-condensing a monovalent carboxylic acid with an alcoholic hydroxyl group of a condensed fatty acid obtained by dehydration-condensing a ricinoleic acid;

(B) an ester compound provided by a dehydration condensate of a monovalent or multivalent alcohol and a monovalent carboxylic acid;

(C) an amine compound; and (D) water. A blend ratio of the component A is 10 mass % or more of a total amount of the oil agent and a blend ratio of the component B is 5 mass % or more of the total amount of the oil agent.

20 Claims, No Drawings

WATER-SOLUBLE METALWORKING OIL AGENT AND USAGE THEREOF

This application is a 371 of PCT/JP2010/070875, filed Nov. 24, 2010.

TECHNICAL FIELD

The present invention relates to a water-soluble metalworking oil agent usable for metalworking such as cutting and grinding and a method of using the same.

BACKGROUND ART

For cutting and grinding, mineral oils, animal and vegetable oils or synthetic oils are frequently blended with a compound having surface-active properties to provide a water-soluble oil agent, and diluted with water so as to be used as a so-called O/W emulsion or the like.

Representative examples of the compound having surface-active properties are fatty acid amine salts, polyoxyalkylene glycols and mono- or di-ether compounds thereof. For instance, in order to increase the antifoaming capabilities and decay resistance of a water-soluble oil agent to a desired level, it has been suggested to blend an amine salt of a ricinoleic acid polymer (see Patent Literature 1). Typically, paraffin chloride has been blended to enhance efficiency in cutting or grinding. However, since it was pointed out that the use of paraffin chloride may lead to emission of dioxin, which is harmful to human body, or the like, it has been suggested to blend a compound such as sulfur or phosphorus in place of paraffin chloride (see Patent Literature 2).

CITATION LIST

Patent Literature(s)

Patent Literature 1: JP-B-2-5799
Patent Literature 2: JP-A-60-141795

SUMMARY OF THE INVENTION

Problems to be Solved by the Invention

When a oil agent as disclosed in Patent Literature 1, which is provided by blending an amine salt of a recinoleic acid polymer and a mineral oil, is used for metalworking of a difficult-to-cut material such as a titanium alloy, a load on a tool is increased because of a shortage in lubricity or the like, which results in a reduced lifetime of the tool or the like. When sulfur or phosphorous is blended as disclosed in Patent Literature 2, it may adversely affect the environment and human body.

Accordingly, an object of the invention is to provide a water-soluble metalworking oil agent capable of providing an excellent machinability to difficult-to-machine materials without being blended with a compound containing chlorine, sulfur or phosphorus and prolonging the lifetime of a tool.

Means for Solving the Problems

In order to solve the above-mentioned problems, according to aspects of the invention, there are provided the following water-soluble metalworking oil agent and method of using the same.

(1) A water-soluble metalworking oil agent provided by blending the following components A, B, C and D:

(A) at least one of a condensed fatty acid obtained by dehydration-condensing a ricinoleic acid, and a condensed fatty acid obtained by dehydration-condensing a monovalent carboxylic acid with an alcoholic hydroxyl group of a condensed fatty acid obtained by dehydration-condensing a ricinoleic acid;

(B) an ester compound provided by a dehydration condensate of a monovalent or multivalent alcohol and a monovalent carboxylic acid;

(C) an amine compound; and (D) water. A blend ratio of the component A is 10 mass % or more of a total amount of the oil agent and a blend ratio of the component B is 5 mass % or more of the total amount of the oil agent.

(2) It is preferable that the metalworking oil agent is used for cutting and grinding.

(3) It is preferable that the metalworking oil agent is used for end milling.

(4) It is preferable that the metalworking oil agent is used for metalworking of a difficult-to-machine material.

(5) It is preferable that the difficult-to-machine material is one of titanium, a titanium alloy, a nickel alloy, a magnesium alloy, a niobium alloy, a tantalum alloy, a molybdenum alloy, a tungsten alloy, a stainless steel and a high-manganese steel.

(6) A method of using the water-soluble metalworking oil agent, including diluting the water-soluble metalworking oil agent with water in use so that the water-soluble metalworking oil agent is used at a concentration of 3 vol % or more.

The water-soluble metalworking oil agent according to the above aspect of the invention is excellent in friction modification between a tool and a material, so that the water-soluble metalworking oil agent can significantly prolong the lifetime of the tool even when being applied to so-called difficult-to-machine materials such as titanium and a titanium alloy.

DESCRIPTION OF EMBODIMENT(S)

According to an exemplary embodiment of the invention, a water-soluble metalworking oil agent (hereinafter also referred to as "oil agent") is provided by blending the following components A, B, C and D. In other words, the oil agent is a stock solution intended to be diluted with water in use.

(A) at least one of a condensed fatty acid obtained by dehydration-condensing a ricinoleic acid, and a condensed fatty acid obtained by dehydration-condensing a monovalent carboxylic acid with an alcoholic hydroxyl group of a condensed fatty acid obtained by dehydration-condensing a ricinoleic acid (B) an ester compound provided by a dehydration condensate of a monovalent or multivalent alcohol and a monovalent carboxylic acid (C) an amine compound (D) water First of all, the component A will be described. The component A is obtained by dehydration polycondensation of a ricinoleic acid (12-hydroxyoctadeca-9-enonic acid). For instance, when the ricinoleic acid is heated to approximately 200 degrees C. under an inert atmosphere, the dehydration polycondensation is started to provide a polycondensed fatty acid. Such a polycondensed fatty acid is usable as the component A according to the exemplary embodiment.

The component A may be a polycondensed fatty acid obtained by dehydration condensation of a monovalent carboxylic acid with an alcoholic hydroxyl group of a polycondensed fatty acid obtained by dehydration polycondensation of a ricinoleic acid. Such a polycondensed fatty acid is obtainable by further adding a monovalent carboxylic acid to the dehydration polycondensate of the ricinoleic acid described above for dehydration polycondensation.

The monovalent carboxylic acid used for such a reaction, which may be saturated or unsaturated, is preferably a carboxylic acid having 4 or more carbon atoms because when a carboxylic acid having the small number of carbon atoms is unreacted to remain, the carboxylic acid is likely to emit an uncomfortable smell or cause metallic corrosion. Examples of the saturated carboxylic acid are caproic acid, enanthic acid, caprylic acid, 2-ethylhexanoic acid, pelargonic acid, isononanoic acid, capric acid, neodecanoic acid, lauric acid, myristic acid, palmitic acid, stearic acid, arachidic acid, behenic acid and lignoceric acid. Examples of the unsaturated carboxylic acid are undecylenic acid, oleic acid, elaidic acid, erucic acid, nervonic acid, linolic acid, γ-linolenic acid, arachidonic acid, α-linolenic acid, stearidonic acid, eicosapentaenoic acid and docosahexaenoic acid.

Next, the component B will be described. The component B is a dehydration-condensate of a monovalent or multivalent alcohol and a monovalent carboxylic acid. In other words, the component B is an ester compound. The monovalent or multivalent alcohol is not particularly limited but a variety of alcohols may be usable. Examples of the monovalent alcohol are: aliphatic monoalcohols such as methyl alcohol, ethyl alcohol, n-propyl alcohol or isopropyl alcohol, a variety of butyl alcohols, a variety of pentyl alcohols, a variety of hexyl alcohols, a variety of octyl alcohols, a variety of decyl alcohols and a variety of dodecyl alcohols; alicyclic monoalcohols such as cyclopentyl alcohol and cyclohexyl alcohol; and aromatic aliphatic alcohols such as benzyl alcohol and phenethyl alcohol.

Examples of the divalent alcohol are: aliphatic alcohols such as ethylene glycol, propylene glycol, butylene glycol, neopentylene glycol and tetramethylene glycol; and alicyclic alcohols such as cyclohexanediol and cyclohexanedimethanol. Examples of the trivalent alcohol are: aliphatic alcohols such as glycerin, trimethylolpropane, trimethylolethane, trimethylolbutane and 1,3,5-pentanetriol; and alicyclic alcohols such as cyclohexanetriol and cyclohexanetrimethanol. Examples of the tetravalent or higher alcohol are aliphatic alcohols such as pentaerythritol, diglycerin, triglycerin, sorbitol and dipentaerythritol.

As the monovalent carboxylic acid for forming the component B, the monovalent carboxylic acid for forming the component A is usable.

Next, the component C will be described. The component C is an amine compound. The amine compound may be a primary, secondary or tertiary amine or an alcohol amine.

Examples of the primary amine are monoethanolamine, monopropanolamine, monoisopropanolamine, 2-amino-1-butanol, 2-amino-2-methylpropanol, butylamine, pentylamine, hexylamine, cyclohexylamine, octylamine, laurylamine, stearylamine, oleylamine and benzylamine.

Examples of the secondary amine are diethylamine, diisopropylamine, dibutylamine, dipentylamine, dihexylamine, dicyclohexylamine, dioctylamine, dilaurylamine, distearylamine, dioleylamine, dibenzylamine, diethanolamine, piperazine, diisopropanolamine, stearylethanolamine, decylethanolamine, hexylpropanolamine, benzilethanolamine, phenylethanolamine and tolylpropanolamine.

Examples of the tertiary amine are tributylamine, tripentylamine, trihexylamine, tricyclohexylamine, trioctylamine, trilaurylamine, tristearylamine, trioleylamine, tribenzylamine, methyldicyclohexylamine, dioleylethanolamine, dilaurylpropanolamine, dioctylethanolamine, dibutylethanolamine, diethylethanolamine, dimethylethanolamine, dihexylpropanolamine, dibutylpropanolamine, oleyldiethanolamine, stearyldipropanolamine, lauryldiethanolamine, octyldipropanolamine, butyldiethanolamine, methyldiethanolamine, cyclohexyldiethanolamine, benzyldiethanolamine, phenyldiethanolamine, tolyldipropanolamine, xylyldiethanolamine, triethanolamine, tripropanolamine and triisopropanolamine.

These amine compounds can be combined with the component A (carboxylic acid) to provide an amine salt to contribute to an improvement in water solubility and lubricity.

The component D for forming the oil agent is water. The water is not particularly limited to high-purity water such as distilled water and may be tap water.

The oil agent is provided by blending the above four components A to D. The blend ratio of the component A is 10 mass % or more of the total amount of the oil agent, preferably 20 mass % or more of the total amount of the oil agent, more preferably 30 mass % or more of the total amount of the oil agent. When the blend ratio of the component A is less than 10 mass %, the oil agent is unlikely to be sufficiently effective in friction modification and prolongation of the lifetime of a tool, though depending on a dilution ratio (described later).

The blend ratio of the component B is 5 mass % or more of the total amount of the oil agent, preferably 10 mass % or more of the total amount of the oil agent, more preferably 15 mass % or more of the total amount of the oil agent. When the blend ratio of the component B is less than 5 mass %, the oil agent is unlikely to be sufficiently effective in friction modification and prolongation of the lifetime of a tool, though depending on a dilution ratio (described later).

For preparing the oil agent (stock solution), water (component D) is added to the components A, B and C. The ratio of the water for preparing the stock solution is preferably in a range of approximately 5 mass % to 75 mass %. When the ratio of the water is less than 5 mass %, the components A to C are difficult to be dissolved, which complicates preparation of the stock solution. When the ratio of the water exceeds 75 mass %, the storage amount and the transport amount of the stock solution become excessive, thereby reducing handleability.

The stock solution is further diluted with water in use. A preferable concentration of the resulting fluid is 3 vol % or more. A more preferable concentration after the dilution is 5 vol % or more. A further preferable total concentration is 10 vol %. When the concentration after the water dilution is less than 3 vol %, the fluid is unlikely to be sufficiently effective in friction modification and prolongation of the lifetime of a tool.

It should be noted that the exemplary embodiment does not necessarily require all the blended components to be uniformly dissolved in the fluid (which may be the stock solution or be diluted). Thus, these components may be dissolved in a dispersed state such as emulsion.

Any other component may be further added to the oil agent as long as an object of the invention is attainable. For instance, a lubricity improver, a metal deactivator, an antifoaming agent, a bactericide and an antioxidant may be added.

Examples of the lubricity improver are mineral oil, synthetic oil, vegetable oil, organic acid and surfactant.

Examples of the mineral oil are: a distillate oil obtained by distilling a paraffin-base crude oil, an intermediate-base crude oil or a naphthene-base crude oil at an ordinary pressure or distilling an ordinary-pressure-distillation residue oil under a diminished pressure; and a refined oil obtained by refining the distilled oil in accordance with an ordinary method, which specifically includes a solvent refined oil, a hydrogenated refined oil, a dewaxing treated oil and a white clay treated oil.

Examples of the synthetic oil are: low-molecular-weight polybutene; low-molecular-weight polypropylene; alkylaromatic compounds such as alkylbenzene and alkylnaphthalene; silicone oil; and fluorine oil (e.g. fluorocarbon and perfluoropolyether).

Examples of the vegetable oil are cotton oil, olive oil, canola oil, benne oil, sunflower seed oil, coconut oil, palm oil, tall oil, soybean oil, castor oil and linseed oil.

Examples of the organic acid are caprylic acid, pelargonic acid, isononanoic acid, capric acid, lauric acid, stearic acid, oleic acid, benzoic acid, p-tert-butylbenzoic acid, adipic acid, suberic acid, sebacic acid, azelaic acid and dodecane diacid.

Examples of the surfactant are an anionic surfactant, a cationic surfactant, a nonionic surfactant and an amphoteric surfactant. Examples of the anionic surfactant are an alkylbenzene sulfonate and an alpha olefin sulfonate. Examples of the cationic surfactant are quaternary ammonium salts such as alkyl trimethyl ammonium salt, dialkyl dimethyl ammonium salt and alkyl dimethyl benzyl ammonium salt. Examples of the nonionic surfactant are: ethers such as polyoxyethylene alkyl ether and polyoxyethylene alkyl phenyl ether; esters such as sorbitan fatty acid ester, polyoxyethylene sorbitan fatty acid ester and polyoxyethylene fatty acid ester; and amides such as fatty acid alkanolamide. An example of the amphoteric surfactant is alkylbetaine (a betaine system).

Examples of the metal deactivator are benzotriazole, imidazoline, pyrimidine derivatives and thiadiazole.

Examples of the antioxidant are: amine antioxidants such as alkylated diphenylamine, phenyl-α-naphthylamine and alkylated phenyl-α-naphthylamine; phenol antioxidants such as 2,6-di-tert-butylphenol, 4,4'-methylenebis(2,6-di-tert-butylphenol), isooctyl-3-(3,5-di-tert-butyl-4-hydroxyphenyl) propionate and n-octadecyl-3-(3,5-di-tert-butyl-4-hydroxyphenyl)propionate; sulfur antioxidants such as dilauryl-3,3'-thiodipropionate; phosphorus antioxidants such as phosphite; and molybdenum antioxidants.

Examples of the bactericide are a triazine preservative and an alkyl benzoimidazole preservative.

Examples of the antifoaming agent are methylsilicone oil, fluorosilicone oil and polyacrylate.

As described above, the water-soluble metalworking oil agent according to the exemplary embodiment can be diluted with water as necessary so that its concentration is adjusted suitably for the usage, and thus can be favorably applicable in various metalworking fields such as cutting, grinding, punching, polishing, squeezing, drawing and flatting. The water-soluble metalworking oil agent according to the exemplary embodiment, which is excellent in lubricity, is suitable for metalworking of so-called difficult-to-machine materials. Specifically, the water-soluble metalworking oil agent is suitable for metalworking of difficult-to-machine materials such as titanium, a titanium alloy, a nickel alloy, a magnesium alloy, a niobium alloy, a tantalum alloy, a molybdenum alloy, a tungsten alloy, a stainless steel and a high-manganese steel. In particular, the water-soluble metalworking oil agent is favorably usable for end milling of difficult-to-machine materials.

In the exemplary embodiment, a compound containing chlorine, sulfur or phosphorus may be further blended. However, in consideration of environmental burden and adverse influences on human body, the use of a compound containing such an element should basically be reduced. According to the exemplary embodiment, it is possible to provide an excellent machinability to difficult-to-machine materials without blending a compound containing chlorine, sulfur or phosphorus.

EXAMPLES

Next, the invention will be further described in detail based on Examples, which by no means limit the invention.

Examples 1 to 7 and Comparatives 1 to 8

The water-soluble metalworking oil agent (the stock solution) was prepared in accordance with blend prescriptions shown in Tables 1 and 2. Details of each of the components are as follows.

TABLE 1

| | | Ex. 1 | Ex. 2 | Ex. 3 | Ex. 4 | Ex. 5 | Ex. 6 | Ex. 7 |
|---|---|---|---|---|---|---|---|---|
| Blend Composition of Stock Solution (mass %) | dehydration-condensed fatty acid 1 (Component A)[1)] | 20 | 20 | — | 15 | 10 | 20 | 20 |
| | dehydration-condensed fatty acid 2 (Component A)[2)] | — | — | 20 | — | — | — | — |
| | tall oil fatty acid | — | — | — | 5 | 10 | — | — |
| | pentaerythritoltetra-2-ethylhexalate (Comonent B) | 20 | — | 20 | 20 | 20 | 10 | 5 |
| | 2-ethylhexylpalmitate (Component B) | — | 20 | — | — | — | — | — |
| | mineral oil[3)] | — | — | — | — | — | 10 | 15 |
| | monoisopropanolamine (Component C) | 8 | 8 | 8 | 8 | 8 | 8 | 8 |
| | N-methyldicyclohexylamine (Component C) | 10 | 10 | 10 | 10 | 10 | 10 | 10 |
| | benzotriazole | 1 | 1 | 1 | 1 | 1 | 1 | 1 |
| | dodecane diacid | 1 | 1 | 1 | 1 | 1 | 1 | 1 |
| | sebacic acid | 2 | 2 | 2 | 2 | 2 | 2 | 2 |
| | pelargonic acid | 10 | 10 | 10 | 10 | 10 | 10 | 10 |
| | sorbitan monooleate | 3 | 3 | 3 | 3 | 3 | 3 | 3 |
| | polyoxyethylene monoalkyl ether | 3 | 3 | 3 | 3 | 3 | 3 | 3 |
| | water | 22 | 22 | 22 | 22 | 22 | 22 | 22 |
| Evaluation Results | friction coefficient after 10 times of sliding motion | 0.20 | 0.23 | 0.23 | 0.22 | 0.23 | 0.22 | 0.23 |
| | tool lifetime (min) | 52 | 45 | 43 | 47 | 42 | 43 | 38 |

TABLE 2

| | | Comp. 1 | Comp. 2 | Comp. 3 | Comp. 4 | Comp. 5 | Comp. 6 | Comp. 7 | Comp. 8 |
|---|---|---|---|---|---|---|---|---|---|
| Blend Composition of Stock Solution (mass %) | dehydration-condensed fatty acid 1 (Component A)[1] | 5 | — | 20 | 20 | 15 | 10 | 5 | — |
| | dehydration-condensed fatty acid 2 (Component A)[2] | — | — | — | — | — | — | — | — |
| | tall oil fatty acid | 15 | 20 | | — | 5 | 10 | 15 | 20 |
| | pentaerythritoltetra-2-ethylhexalate (Comonent B) | 20 | 20 | 2.5 | — | — | — | — | — |
| | 2-ethylhexylpalmitate (Component B) | — | — | — | — | — | — | — | — |
| | mineral oil[3] | — | — | 17.5 | 20 | 20 | 20 | 20 | 20 |
| | monoisopropanolamine (Component C) | 8 | 8 | 8 | 8 | 8 | 8 | 8 | 8 |
| | N-methyldicyclohexylamine (Component C) | 10 | 10 | 10 | 10 | 10 | 10 | 10 | 10 |
| | benzotriazole | 1 | 1 | 1 | 1 | 1 | 1 | 1 | 1 |
| | dodecane diacid | 1 | 1 | 1 | 1 | 1 | 1 | 1 | 1 |
| | sebacic acid | 2 | 2 | 2 | 2 | 2 | 2 | 2 | 2 |
| | pelargonic acid | 10 | 10 | 10 | 10 | 10 | 10 | 10 | 10 |
| | sorbitan monooleate | 3 | 3 | 3 | 3 | 3 | 3 | 3 | 3 |
| | polyoxyethylene monoalkyl ether | 3 | 3 | 3 | 3 | 3 | 3 | 3 | 3 |
| | water | 22 | 22 | 22 | 22 | 22 | 22 | 22 | 22 |
| Evaluation Results | friction coefficient after 10 times of sliding motion | 0.29 | 0.32 | 0.28 | 0.28 | 0.29 | 0.31 | 0.33 | 0.36 |
| | tool lifetime (min) | — | 25 | — | 32 | — | — | — | 11 |

[1]Under a nitrogen atmosphere, a ricinoleic acid was subjected to dehydration condensation while being heated at 200 degrees C. After being added with a lauric acid, the ricinoleic acid was further subjected to dehydration condensation while being heated, thereby obtaining a dehydration-polycondensed fatty acid 1 (acid value: 85 mgKOH/g, hydroxyl value: 9 mgKOH/g, saponification value: 200 mgKOH/g).
[2]Under a nitrogen atmosphere, a ricinoleic acid was subjected to dehydration condensation while being heated at 200 degrees C., thereby obtaining a dehydration-polycondensed fatty acid 2 (acid value: 52 mgKOH/g, hydroxyl value: 20 mgKOH/g, saponification value: 196 mgKOH/g).
[3]a naphthene mineral oil (kinematic viscosity at 40 degrees C.: 26 $mm^2/s$)

The stock solution prepared based on each blend prescription was diluted with water and the following properties thereof were evaluated. Evaluation results are shown in Tables 1 and 2.

Friction Modification

A friction portion was slid under the following conditions using a reciprocating friction testing machine for a friction test and a friction coefficient was measured after a final sliding motion.

Testing sphere: diameter . . . 3/16 inches, material . . . superhard

Testing plate: material . . . a titanium alloy (Ti-6Al-4V)

Load: 1.96 N (200 gf)

Sliding speed: 20 mm/s

Sliding distance: 40 mm

The number of sliding motions: 10 times

Testing temperature: 25 degrees C.

Diluted concentration: 10 vol % (water dilution)

(The stock solution of Example 1 was measured also for diluted concentrations of 5 vol % and 2.5 vol %.)

Application amount: 0.05 ml

Machinability (End Milling)

End milling was conducted under the following conditions using a vertical machining center. It was understood that a tool lifetime ran out when the flank wear of a tool exceeded 0.2 mm or tool breakage occurred. A machining time before the tool lifetime ran out was compared among Examples and Comparatives.

Used equipment: Vertical Machining Center NV5000α1/A40 manufactured by Mori Seiki Co., Ltd.

Machined material: Ti-6AL-4V, ø 150×30 mm, disk-like shape

Insert: XOMX090308TR-ME06, F40M (S30-type) manufactured by SECO TOOLS

Cutter: Helical Micro Turbo R217.69-2020.3-016-09.2 manufactured by SECO TOOLS

Holder: HSK63A Milling Chuck CT20A manufactured by NT TOOL CORPORATION

Cutting speed: 55 m/min

Cutting dimension: ap (a tool-axial direction)=2 mm, ae (a tool-radial direction)=16 mm Feeding: 0.1 mm/tooth Oil-supply method: external oil supply, 3.7 L/min Diluted concentration: 10 vol % (water dilution)

Evaluation Results

As shown in Table 1, it has been understood that since the water-soluble metalworking oil agent according to the invention is prepared by blending only the predetermined three components in the predetermined amounts, the water-soluble metalworking oil agent exhibits a small friction coefficient, and can thus prolong the tool lifetime even when used for metalworking of difficult-to-machine materials. The stock solution of Example 1 had a friction coefficient of 0.23 when the diluted concentration was 5 vol % and a friction coefficient of 0.29 when the diluted concentration was 2.5 vol %.

In contrast, Table 2 shows that when a oil agent contains none of the predetermined three components or contains the predetermined three components in amounts out of the predetermined ranges, the oil agent exhibits a high friction coefficient and thus the tool lifetime is shortened.

The invention claimed is:

1. A metalworking method of a material employing a water-soluble metalworking oil agent, wherein the water-soluble metalworking oil agent is prepared by blending the following components (A)-(D):

(A) at least one selected from the group consisting of (a1) a condensed fatty acid obtained by dehydration-condensing a ricinoleic acid and (a2) a condensed fatty acid obtained by dehydration-condensing a monovalent carboxylic acid with an alcoholic hydroxyl group of a condensed fatty acid obtained by dehydration-condensing a ricinoleic acid;

(B) an ester compound obtained by dehydration-condensing a monovalent or multivalent alcohol and a monovalent carboxylic acid;

(C) an amine compound; and (D) water, wherein a blend ratio of the component A is 10 mass % or more, based on a total mass of the oil agent, and a blend ratio of the component B is 5 mass % or more, based on the total mass of the oil agent, said method comprising:

metalworking of a difficult-to-machine material with said water-soluble metalworking oil agent, wherein the difficult-to-machine material is at least one selected from the group consisting of titanium and a titanium alloy.

2. The method of claim 1, wherein said metalworking is cutting and grinding.

3. The method of claim 2, wherein said metalworking is end milling.

4. The method of claim 1, the method further comprising:

diluting the oil agent with water, to obtain a diluted oil agent, wherein a content of the oil agent in the diluted oil agent is 3 vol % or more.

5. The method of claim 1, wherein the blend ratio of the component A is 20 mass % or more, based on the total mass of the oil agent.

6. The method of claim 1, wherein the blend ratio of the component A is 30 mass % or more, based on the total mass of the oil agent.

7. The method of claim 1, wherein the blend ratio of the component B is 10 mass % or more, based on the total mass of the oil agent.

8. The method of claim 5, wherein the blend ratio of the component B is 10 mass % or more, based on the total mass of the oil agent.

9. The method of claim 6, wherein the blend ratio of the component B is 10 mass % or more, based on the total mass of the oil agent.

10. The method of claim 1, wherein the blend ratio of the component B is 15 mass % or more, based on the total mass of the oil agent.

11. The method of claim 5, wherein the blend ratio of the component B is 15 mass % or more, based on the total mass of the oil agent.

12. The method of claim 6, wherein blend ratio of the component B is 15 mass % or more, based on the total mass of the oil agent.

13. The method of claim 1, wherein the blend ratio of the water (D) is in a range from 5 to 75 mass %, based on the total mass of the oil agent.

14. The method of claim 1, wherein the component (A) comprises the condensed fatty acid (a1).

15. The method of claim 1, wherein the component (A) comprises the condensed fatty acid (a2).

16. The method of claim 14, wherein the component (A) comprises the condensed fatty acid (a2).

17. The method of claim 16, wherein the monovalent carboxylic acid of the condensed fatty acid (a2) comprises 4 or more carbon atoms.

18. The method of claim 1, further comprising:

adding at least one additive selected from the group consisting of a lubricity improver, a metal deactivator, an antifoaming agent, a bactericide, and an antioxidant.

19. The method of claim 1, wherein the difficult-to-machine material is titanium.

20. The method of claim 1, wherein the difficult-to-machine material is a titanium alloy.

* * * * *

UNITED STATES PATENT AND TRADEMARK OFFICE

CERTIFICATE OF CORRECTION

PATENT NO. : 9,029,306 B2
APPLICATION NO. : 13/498817
DATED : May 12, 2015
INVENTOR(S) : Fumiaki Takagi et al.

It is certified that error appears in the above-identified patent and that said Letters Patent is hereby corrected as shown below:

On the title page, Item (73), the Assignee's information is incorrect. Item (73) should read:

--(73) Assignee: Idemitsu Kosan Co., Ltd., Tokyo, (JP)--

Signed and Sealed this
Twenty-eighth Day of June, 2016

Michelle K. Lee

Michelle K. Lee
*Director of the United States Patent and Trademark Office*